US008988473B2

(12) United States Patent
Okazaki et al.

(10) Patent No.: US 8,988,473 B2
(45) Date of Patent: Mar. 24, 2015

(54) DRIVING METHOD OF LIQUID CRYSTAL DISPLAY DEVICE

(71) Applicant: Japan Display Inc., Tokyo (JP)

(72) Inventors: Kengo Okazaki, Mobara (JP); Kozo Arisato, Ichihara (JP); Tomoki Nakamura, Chiba (JP)

(73) Assignee: Japan Display Inc., Tokyo (JP)

( * ) Notice: Subject to any disclaimer, the term of this patent is extended or adjusted under 35 U.S.C. 154(b) by 37 days.

(21) Appl. No.: 14/011,866

(22) Filed: Aug. 28, 2013

(65) Prior Publication Data

US 2014/0063081 A1 Mar. 6, 2014

(30) Foreign Application Priority Data

Aug. 29, 2012 (JP) ..... 2012-188667

(51) Int. Cl.

| | |
|---|---|
| ***G09G 5/10*** | (2006.01) |
| ***G09G 3/36*** | (2006.01) |
| ***G09G 3/18*** | (2006.01) |
| *G09G 3/20* | (2006.01) |

(52) U.S. Cl.

CPC ..... *G09G 3/18* (2013.01); *G09G 3/3648* (2013.01); *G09G 3/2003* (2013.01); *G09G 2340/06* (2013.01); *G09G 2360/144* (2013.01)

USPC ..... 345/690; 345/87; 345/102

(58) Field of Classification Search

CPC ..... G09G 2340/06; G09G 2360/144; G09G 3/18; G09G 3/2003; G09G 3/3648

USPC ..... 345/87–102, 207, 589, 603, 617, 690

See application file for complete search history.

(56) References Cited

U.S. PATENT DOCUMENTS

| | | | | |
|---|---|---|---|---|
| 7,176,879 | B1 * | 2/2007 | Yoshihara et al. | 345/102 |
| 2003/0025709 | A1 * | 2/2003 | Kim et al. | 345/589 |
| 2009/0213300 | A1 * | 8/2009 | Daiku | 349/65 |
| 2010/0033456 | A1 * | 2/2010 | Yoshida et al. | 345/207 |
| 2011/0018856 | A1 * | 1/2011 | Den Boer et al. | 345/211 |

FOREIGN PATENT DOCUMENTS

JP 2008-287068 A 11/2008

* cited by examiner

*Primary Examiner* — Hong Zhou
(74) *Attorney, Agent, or Firm* — Ulmer & Berne LLP

(57) ABSTRACT

Under a normal environment, when red, green and blue displays are to be performed, the displays are performed singly by a red pixel, a green pixel and a blue pixel respectively, and under a high-illuminance environment, when the red display is to be performed, the display is performed by also shining the pixels other than the red pixel simultaneously, when the green display is to be performed, the display is performed by also shining the pixels other than the green pixel simultaneously, and when the blue display is to be performed, the display is performed by also shining the pixels other than the blue pixel simultaneously, thereby increasing the luminance of a screen. In this case, although the chromaticity of each color is lowered, since the luminance works more predominantly on the image quality under the high-illuminance environment than the chromaticity, image quality degradation does not occur.

9 Claims, 7 Drawing Sheets

FIG. 5

| | GRADATION (EACH 8-BIT) | | | | | | | | |
|---|---|---|---|---|---|---|---|---|---|
| | R | | | G | | | B | | |
| UNDER NORMAL ENVIRONMENT sRGB (COLOR REPRODUCIBILITY 70%) | R | G | B | R | G | B | R | G | B |
| | 255 | 0 | 0 | 0 | 255 | 0 | 0 | 0 | 255 |
| UNDER HIGH-ILLUMINANCE ENVIRONMENT sRGB ANALOGY (COLOR REPRODUCIBILITY 50%) | R | G | B | R | G | B | R | G | B |
| | 249 | 99 | 0 | 38 | 255 | 82 | 0 | 82 | 255 |

| COLOR | LUMINANCE INCREASE RATE |
|---|---|
| RED | 7% |
| GREEN | 4% |
| BLUE | 82% |

DRIVING METHOD OF LIQUID CRYSTAL DISPLAY DEVICE

CLAIM OF PRIORITY

The present application claims priority from Japanese Patent Application JP 2012-188667 filed on Aug. 29, 2012, the content of which is hereby incorporated by reference into this application.

BACKGROUND OF THE INVENTION

1. Field of the Invention

The present invention relates to a display device and more particularly relates to a liquid crystal display device allowing to maintain a contrast without increasing power consumption even under a light environment.

2. Description of the Related Art

In the liquid crystal display device, a TFT substrate on which pixels having pixel electrodes and thin film transistors (TFT) are arranged in a matrix and a counter substrate on which color filters and the like are formed at places corresponding to the pixel electrodes of the TFT substrate are arranged in opposition to each other, and a liquid crystal is nipped and held between the TFT substrate and the counter substrate. Then, an image is formed by controlling transmittance of light through liquid crystal molecules pixel by pixel.

Since the liquid crystal display device is made thin and light-weighted, it is used in a cell phone, a DSD (Digital Still Camera) and others. The cell phone and the DSC are frequently used in the light open air. When the cell phone or the like is to be used in the light open air, the contrast becomes a problem. If the brightness of backlight is increased in order to create a visible contrast, its power consumption will become a problem.

As related art taking measures to a relationship between the power consumption and the contrast, the followings may be given. (1) One system is such that the contrast of a light room is maintained by sensing the illuminance of outdoor light in an environment that a display is used without increasing the power consumption. That is, in this system, while when the outdoor light is light, the power of the backlight is increased, when the outdoor light is dark, the entire power consumption is saved by decreasing the power of the backlight. (2) Another system is such that the power of the backlight is decreased by combining it with backlight control on a menu screen or the like which is little in color information. However, also in this case, input image data is used as it is. (3) A further system is such that a white pixel (W) is added to a red pixel (R), a green pixel (G) and a blue pixel (B) so as to increase the luminance though the color purity is slightly sacrificed.

In addition to systems as mentioned above, a configuration that a first color filter which is excellent in color purity and a second color filter which is higher in transmittance than the first color filter are arranged side by side and the first color filter and the second color filter are separately controlled so as to flexibly cope with various external environments is described in Japanese Patent Application Laid-Open No. 2008-287068.

SUMMARY OF THE INVENTION

The related art (1) is of the system that outdoor light is sensed and the quantity of light of the backlight is adjusted in accordance with the outdoor light so sensed. However, an image signal which is supplied from the outside is used as it is. Therefore, when it frequently occurs that the display device is used under a high-illuminance environment, the power consumption of the backlight is increased. The related art (2) is of the system that it is allowed to reduce the power of the backlight on the screen which is little in color information such as a setting screen or the like. However, the image signal is supplied from the outside also in this case and since it is not the system configured such that the rate of the screen having little color information is positively increased, the reduction in power consumption of the backlight is limited. The related art (3) is of the system that as the pixels, the white pixel (W) and its sub pixels are arranged in addition to sub pixels of the red pixel (R), green pixel (G) and blue pixel (B). Therefore, the area of unit pixel is increased, and when a high-definition screen is to be obtained, there is a limit. Similarly, since the configuration disclosed in Japanese Patent Application Laid-Open No. 2008-287068 is of the type that the first color filter which is excellent in color purity and the second color filter which is higher than the first color filter in transmittance are arranged side by side in one pixel, there is a limit to definition enhancement that the pixel size is to be reduced.

The present invention aims to implement a liquid crystal display device which allows to maintain a required contrast of a screen even in outdoor or the like where the illuminance of outdoor light is high and allows to suppress an increase in the power consumption of the backlight. The present invention also aims to implement such a configuration as mentioned above simply by combining together sub pixels of the red pixel (R), green pixel (G) and blue pixel (B) and to implement the configuration by a configuration coping with a high-definition screen without increasing the area of unit pixel. Incidentally, in the following description, the red pixel (R) or the like will be called a red pixel (R) sub pixel or a red pixel (R) pixel in some cases.

The present invention has been made in order to overcome the above-mentioned disadvantages. That is, the color purity hardly influences the image quality and the brightness or contrast of the screen predominantly influences the image quality under an environment which is high in illuminance of outdoor light such as in outdoors. The present invention uses measures of sensing the illuminance of outdoor light, converting an image signal from the outside when the illuminance of outdoor light is high, intentionally mixing other colors into a predetermined color to increase the luminance of the screen so as to maintain the contrast of the screen even when the illuminance of outdoor light is high. Therefore, it becomes possible to increase the luminance of the screen while saving the power consumption of the backlight. The concrete measures are as follows.

(1) According to one embodiment of the present invention, there is provided, a driving method of liquid crystal display device, including a liquid crystal display panel in which a TFT substrate on which pixels having pixel electrodes and TFTs are arranged in a matrix and a counter substrate are arranged in opposition to each other, a liquid crystal is nipped and held between the TFT substrate and the counter substrate and on which an IC driver is loaded, wherein the pixels include a red pixel (R), a green pixel (G) and a blue pixel (B), under a normal environment, when red, green and blue displays are to be performed, the respective displays are performed singly by the red pixel (R), the green pixel (G) and the blue pixel (B) respectively, under a high-illuminance environment which is higher in outdoor light illuminance than the normal environment, when the red display is to be performed, the display is performed by shining the pixels other than the red pixel (R) simultaneously with shining of the red pixel, when the green display is to be performed, the display is performed by shining the pixels other than the green pixel (G)

simultaneously with shining of the green pixel, and when the blue display is to be performed, the display is performed by shining the pixels other than the blue pixel (B) simultaneously with shining of the blue pixel.

(2) According to another embodiment of the present invention, there is provided, a driving method of liquid crystal display device, including a liquid crystal display panel in which a TFT substrate on which pixels having pixel electrodes and TFTs are arranged in a matrix and a counter substrate are arranged in opposition to each other, a liquid crystal is nipped and held between the TFT substrate and the counter substrate and on which an IC driver is loaded, wherein the pixels include a red pixel (R), a green pixel (G) and a blue pixel (B), under a normal environment, when red, green and blue displays are to be performed, image signal data input into the liquid crystal display panel is used, under a high-illuminance environment which is higher in outdoor light illuminance than the normal environment, an image signal input into the liquid crystal display panel is converted to form new luminance data and chromaticity data, under the high-illuminance environment, when the red display is to be performed, the display is performed by shining the pixels other than the red pixel (R) simultaneously with shining of the red pixel, when the green display is to be performed, the display is performed by shining the pixels other than the green pixel (G) simultaneously with shining of the green pixel, and when the blue display is to be performed, the display is performed by shining the pixels other than the blue pixel (G) simultaneously with shining of the blue pixel.

According to the present invention, under the high-illuminance environment, the luminance of the screen is increased by mixing other colors into a predetermined color also when a monochromatic image is to be displayed. Thus, since it is allowed to visibly confirm the screen by suppressing the power of the backlight even when the illuminance of outdoor light is high, such an advantage is attained that the power consumption is reduced. In addition, since it is allowed to implement enhancement of definition of the screen without increasing the sub pixels such as those of the white pixel (W), it is also allowed to cope with enhancement of definition of the screen.

BRIEF DESCRIPTION OF THE DRAWINGS

FIG. 5 is a table indicating examples of gradation values of respective colors obtained before and after conversion;

DETAILED DESCRIPTION OF THE PREFERRED EMBODIMENTS

Figure 1:
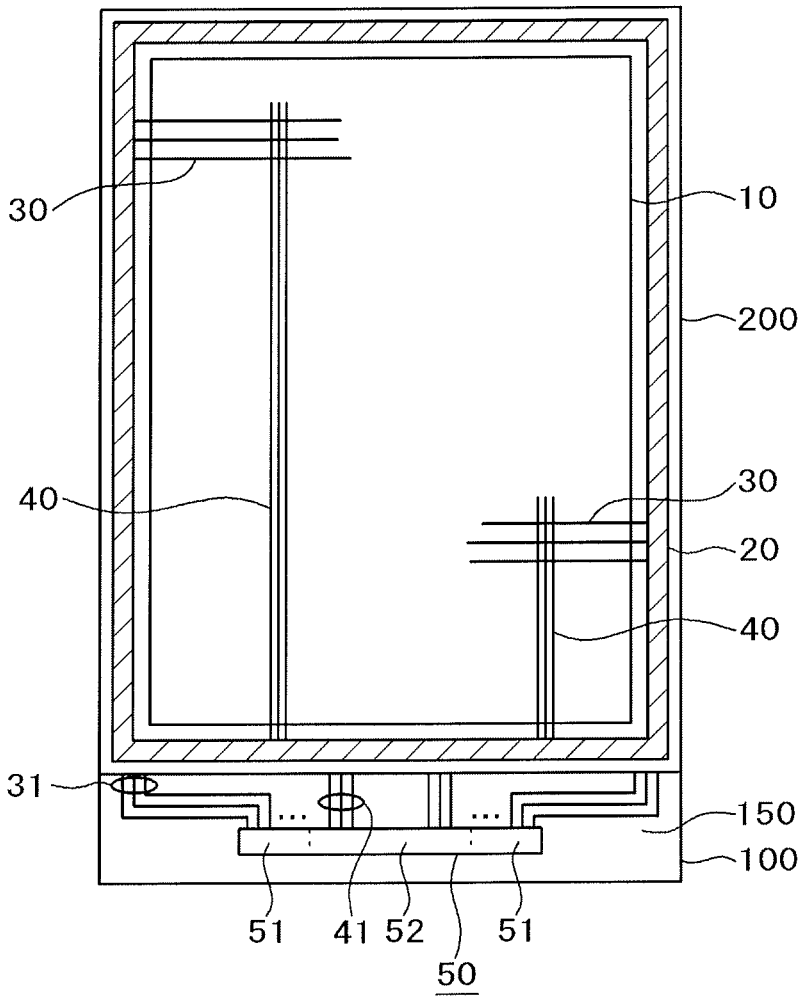
FIG. 1 is a plan view illustrating an example of a liquid crystal display device to which the present invention is applied.

FIG. 1 is a plan view illustrating an example of a small-sized liquid crystal display device to be used in a cell phone or the like which is an example of the product to which the present invention is to be applied. In FIG. 1, a counter substrate 200 is arranged on a TFT substrate 100. A not illustrated liquid crystal layer is nipped and held between the TFT substrate 100 and the counter substrate 200. The TFT substrate 100 and the counter substrate 200 are bonded together with a seal material 20 formed on a frame part. In FIG. 1, since the liquid crystal is sealed into between the substrates by a dropping system, a sealing hole is not formed.

The TFT substrate 100 is formed larger than the counter substrate 200 and a terminal part 150 for supplying power, an image signal, a scan signal and others to a liquid crystal display panel is formed on a portion by which the TFT substrate 100 is formed larger than the counter substrate 200. A not illustrated flexible wiring substrate is connected to the terminal part 150.

In addition, an IC driver 50 for driving a scan signal line 30, an image signal line 40 and others is disposed on the terminal part 150. The IC driver 50 is divided into three sections and an image signal drive circuit 52 is disposed in its central section and scan signal drive circuits 51 are disposed in its both side sections. In the present invention, a measure for converting luminance information (data) and chromaticity information (data) of an image signal supplied from the outside to prepare new luminance information and chromaticity information is loaded within the IC driver 50.

In a display area 10 in FIG. 1, the scan signal lines 30 are extended horizontally and arrayed vertically. In addition, the image signal lines 40 are extended vertically and arrayed horizontally. Each area surrounded by the scan signal lines and the image signal lines configures each pixel. The scan signal lines 30 are connected to the scan signal drive circuits 51 of the IC driver 50 by scan line leader lines 31 from the both sides of the display area 10. Image signal leader lines 41 for connecting together the image signal lines 40 and the IC driver 50 are gathered under the screen and connected to the image signal drive circuit 52 arranged in the central section of the IC driver 50.

Figure 2:
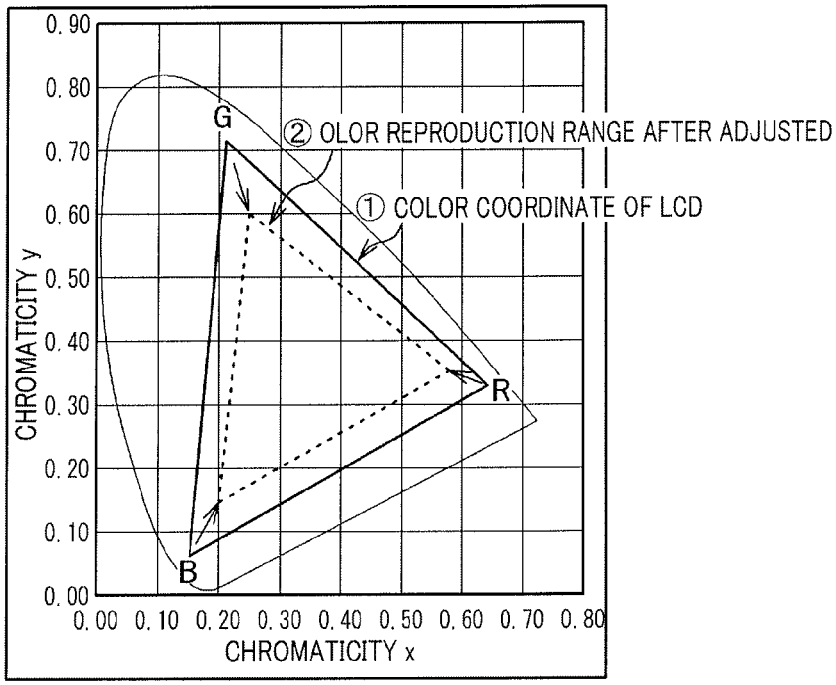
FIG. 2 is a chromaticity diagram illustrating an example of the principle of the present invention.

FIG. 2 is a chromaticity diagram illustrating an example of the principle of the present invention. In FIG. 2, a triangular area indicated by a solid line is an example that the color reproducibility has been defined as 70% in sRGB (standard RGB). The color reproducibility of 70% is defined as the standard color reproducibility for the cell phone, the DSC and others. Incidentally, that the color reproducibility of 70% means that it accounts for 70% of the color reproducibility defined in the NTSC standard.

In the present invention, in case of the normal illuminance of outdoor light, the area of 70% in color reproducibility is used. In the above-mentioned case, data of an image signal from the outside is used as it is. On the other hand, when the illuminance of outdoor light is high in outdoors or the like, the image signal from the outside is not used as it is and the image signal is used by converting it so as to increase the luminance of the screen.

That is, when the illuminance of outdoor light is high, the chromaticity hardly influences image quality and the contrast greatly influences the image quality. Therefore, in the present invention, the luminance data and chromaticity data of the image signal from the outside are converted so as to display the image by increasing the luminance. That is, a reproduction range of the chromaticity is limited to a triangular range indicated by the dotted line in FIG. 2, and the luminance is increased instead. The triangular color reproduction range which is indicated by the dotted line accounts for 50% of the range in the NTSC standard. By configuring as mentioned above, it is allowed to increase the luminance even when the power consumption of the backlight is kept unchanged.

Specifically, for example, even in case of monochromatic display in red, another color, for example, light which is obtained through the green pixel is also mixed into it. In addition, even in case of monochromatic display in green, light which is obtained through the red pixel or the blue pixel is also mixed into it. Further, even in case of monochromatic display in blue, light which is obtained through the green pixel is also mixed into it. Therefore, although the color purity is reduced, it is allowed to increase the luminance. On the other hand, when the outside environment is high in illuminance, the color purity hardly influences the image quality, and the contrast, that is, the luminance of the screen influences the image quality predominantly. Therefore, it looks as if the image quality has been rather increased in human eyes. The present invention makes it possible to attain such an advantage as mentioned above without increasing the power consumption of the backlight.

The present invention has such a feature that the illuminance under the outside environment is sensed by a sensor, when the illuminance of outdoor light has become higher than a predetermined value, the image signal is converted, that is, the luminance data and chromaticity data thereof are converted so as to increase the luminance. Incidentally, a person may sense the illuminance of the outside environment in addition to sensing by the sensor and an instruction to convert the image signal data may be given according to the manual.

Figure 3:
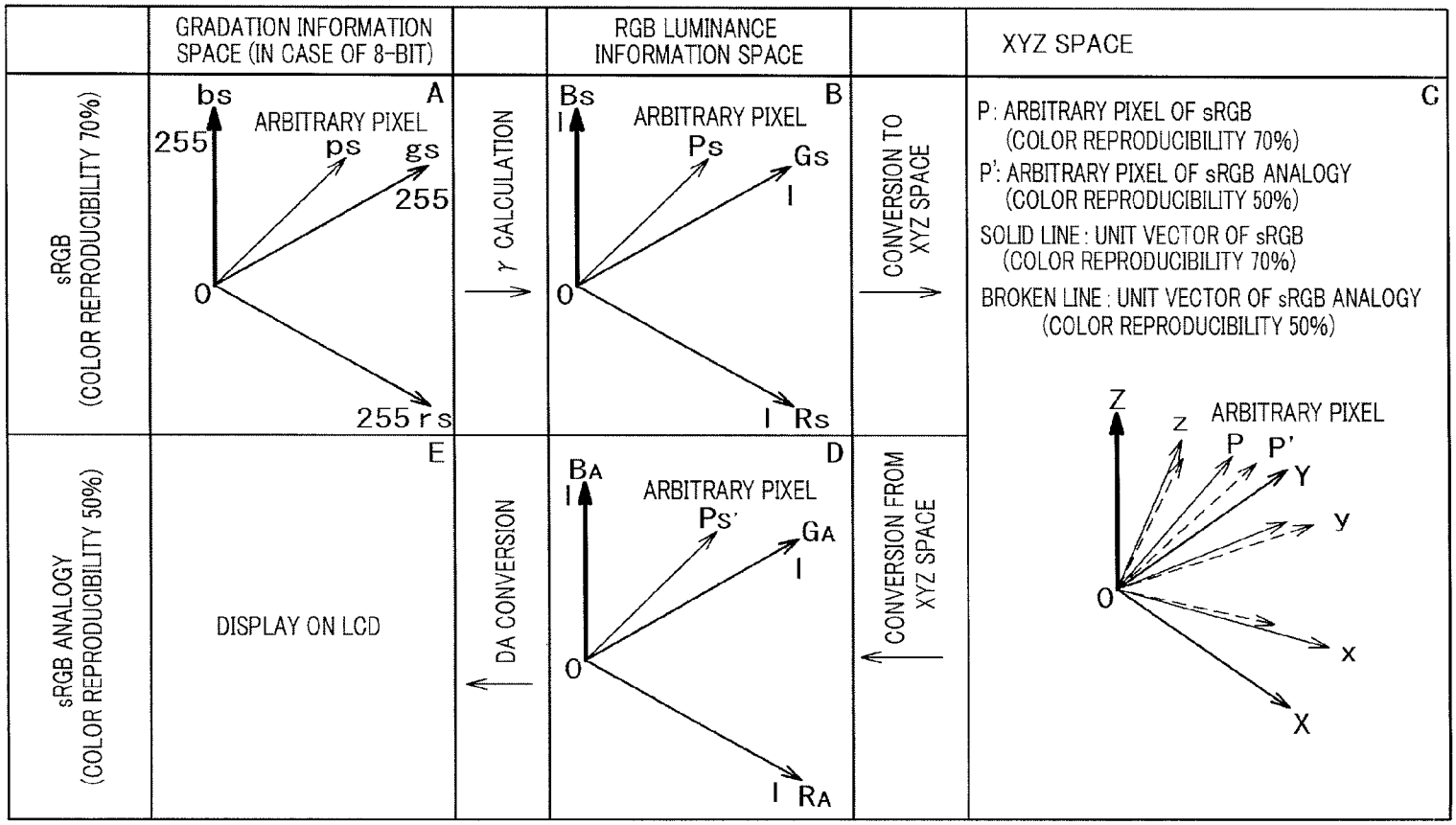
FIG. 3 is a diagram illustrating an example of conversion procedure of image signal data.

FIG. 3 is a table illustrating an example of procedure of conversion for increasing the luminance of the image signal supplied from the outside of the liquid crystal display panel by decreasing the color purity. In FIG. 3, conversion is performed in order of columns A-B-C-D-E. The column A is an RGB gradation information space in original data supplied from the outside. That is, in the column A, respective vectors of RGB with maximum gradation values of 255 and gradation information ps of an arbitrary pixel in case of 8-bit unit are indicated. rs is a 255-gradation vector corresponding to the red pixel (R), gs is a 255-gradation vector corresponding to the green pixel (G), and bs is a 255-gradation vector corresponding to the blue pixel (B). The gradation information ps of the arbitrary pixel in the column A exhibits a bluish green color.

The column B of FIG. 3 indicates that γ characteristic is added to the gradation information of the RGB luminance information space in the column A and the maximum gradation value 255 has been standardized as 1. In the column B, Rs is a vector corresponding to the red pixel (R), Gs is a vector corresponding to the green pixel (G) and Bs is a vector corresponding to the blue pixel (B). Ps is a vector of an arbitrary pixel in the luminance information space.

The column C in FIG. 3 indicates vectors obtained after the data in the luminance information space obtained in the column B has been converted to that in an XYZ space. In FIG. 3, X, Y and Z which are indicated by bold arrows are coordinates used in a conversion formula, in which Y is the coordinate indicating the luminance. x, y and z which are indicated by thin solid-line arrows are unit vectors of sRGB (70% in color reproducibility), x, y and z which are indicated by thin dotted-line arrows are unit vectors of sRGB (50% in color reproducibility), P indicated by a solid-line arrow is a vector in sRGB (70% in color reproducibility) of the arbitrary pixel Ps in the XYZ space, and P' indicated by a dotted-line arrow is a vector in sRGB (50% in color reproducibility) of the arbitrary pixel Ps in the XYZ space.

Although conversion of the luminance and the chromaticity is performed in the XYZ space, a component along the Y-axis functions as an index indicating the magnitude of the luminance. That is, to which extent the luminance is to be increased is determined and it is reflected in the Y component in the XYZ space. X component and Z component are determined corresponding to the Y component. In the column C, when P and P' which are the vectors of the arbitrary pixel Ps are compared with each other, the component along the Y axis is larger in case of sRGB (50% in color reproducibility) than in case of sPGB (70% in color reproducibility). That is, the luminance is increased.

The column D indicates vectors when the unit vectors and the vectors of the arbitrary pixel which have been converted in the XYZ space in the column C have been again converted to those in the RGB luminance information space. In the column D, luminance data obtained when sRGB (50% in color reproducibility) has been adopted is reflected. The column E indicates to input data obtained by performing DA conversion on the luminance data which has been obtained in the column D into the liquid crystal display panel (LCD). In this case, it is supposed that the y characteristic is built into the IC driver loaded on the liquid crystal display panel.

As described above, the present invention has such a feature that the luminance data and the chromaticity data of the image signal which has been supplied from the outside are converted in the IC driver loaded on the liquid crystal display panel so as to suppress the color reproducibility to increase the luminance by an arbitrary amount.

[Embodiment 1]

Figure 4:
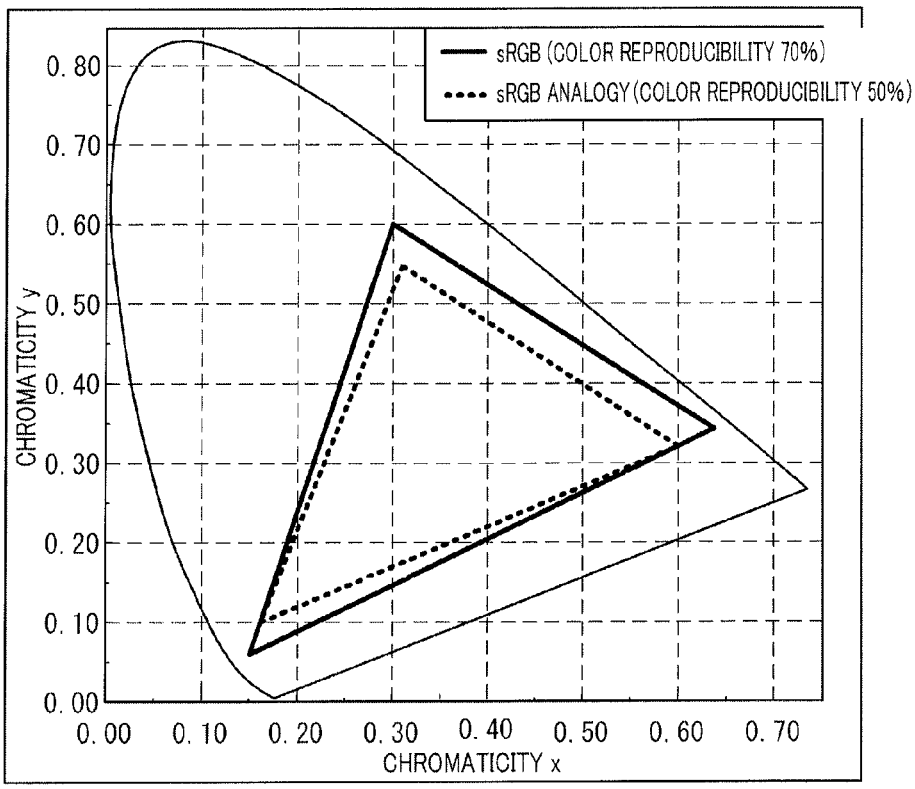
FIG. 4 is a chromaticity diagram illustrating an example that the present invention has been applied to an actual product.

FIG. 4 is a chromaticity diagram illustrating an example that the present invention has been applied to an actual product. In FIG. 4, a solid-line triangle indicates sRGB (70% in color reproducibility) and a dotted-line triangle indicates sRGB (50% in reproducibility). That is, the range of the solid-line triangle is used under the normal environment and the range of the dotted-line triangle is used under the high-illuminance environment. Although the shape of the dotted-line triangle is slightly different from that illustrated in FIG. 2, the shape differs depending on setting of the range to be color-reproduced and the luminance. That is, the shape of the triangle is changed depending on how the range of to be color-reproduced in sRGB (50% in color reproducibility) is set.

FIG. 5 illustrates examples of values of 8-bit-based gradation with which red, green and blue are displayed under the normal environment, that is, in sRGB (70% in color reproducibility), and values of 8-bit-based gradation with which red, green and blue are displayed under the high-illuminance environment, that is, in sRGB (50% in color reproducibility). Under the normal environment, red, green and blue are respectively displayed with maximum gradation values of 255 for the red pixel (R), the green pixel (G) and the blue pixel (B).

On the other hand, under the high-illuminance environment, red, green and blue are respectively displayed not only by using the red pixel (R), the green pixel (G) and the blue pixel (B) but also by mixing other colors into the respective colors. Although the luminance is increased by the amount corresponding to mixture of other colors, the color purity is degraded accordingly. In FIG. 5, in sRGB (50% in color reproducibility), a maximum luminance in red display is attained when red is displayed by shining the red pixel (R) with 249-gradation and shining the green pixel (G) with 99-gradation. Similarly, a maximum luminance in green display is attained when green is displayed by shining the green pixel (G) with 255-gradation, shining the red pixel (R) with 38-gradation and shining the blue pixel (B) with 82-gradation. Also similarly, a maximum luminance in blue display is attained when blue is displayed by shining the blue pixel (B) with 255-gradation and shining the green pixel (G) with 82-gradation. Here, the maximum luminance of each color corresponds to 255-gradation in sRGB (50% in color reproducibility).

As described above, in sRGB (50% in color reproducibility), in case of the maximum luminances of red, green and blue, the luminances are increased by mixing a predetermined amount of green into red for red display, by mixing predetermined amounts of red and blue into green for green display, and mixing a predetermined amount of green into blue for blue display.

Figure 6:
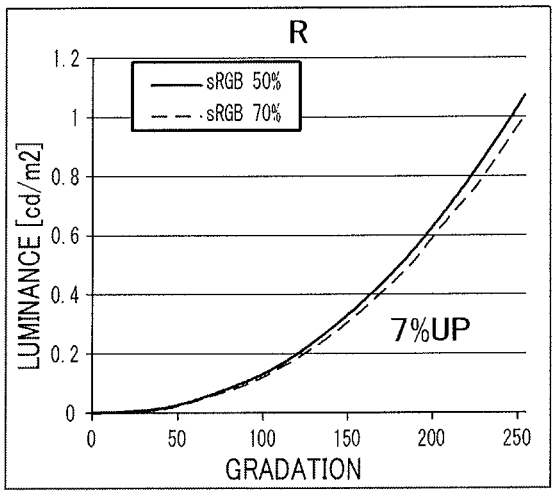
FIG. 6 is a graph illustrating an example that luminances of red light attained by related art and the present invention are compared with each other.

FIG. 6 illustrates an example of comparison between gradation-based luminance between sRGB (70% in color reproducibility) and sRGB (50% in color reproducibility) for red display. In FIG. 6, a horizontal axis indicates the gradation and a vertical axis indicates the luminance. In FIG. 6, a dotted line indicates the luminance in sRGB (70% in color reproducibility) and a solid line indicates the luminance in sRGB (50% in color reproducibility). Comparing the maximum luminances attained with 255-gradation, the luminance in sRGB (50% in color reproducibility) is increased by 7% as compared with that in sRGB (70% in color reproducibility). Here, the luminance in sRGB (50% in color reproducibility) is the one obtained when red has been displayed by shining the red pixel (R) with 249-gradation and shining the green pixel (G) with 99-gradation in FIG. 5.

Figure 7:
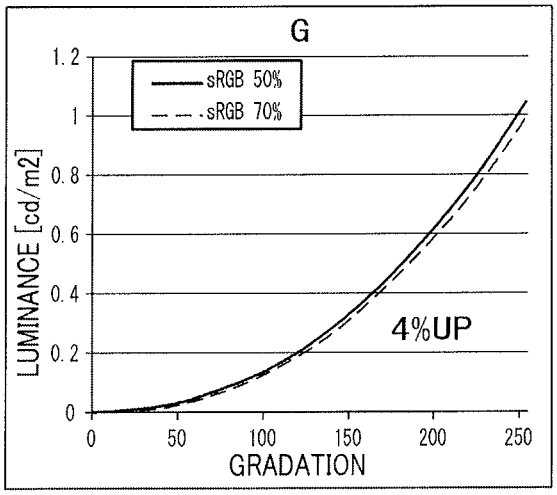
FIG. 7 is a graph illustrating an example that luminances of green light attained by related art and the present invention are compared with each other.

FIG. 7 illustrates an example of comparison between gradation-based luminance between sRGB (70% in color reproducibility) and sRGB (50% in color reproducibility) for green display. In FIG. 7, the horizontal axis indicates the gradation and the vertical axis indicates the luminance. In FIG. 7, the dotted line indicates the luminance in sRGB (70% in color reproducibility) and the solid line indicates the luminance in sRGB (50% in color reproducibility). Comparing the maximum luminances attained with 255-gradation, the luminance in sRGB (50% in color reproducibility) is increased by 4% as compared with that in sRGB (70% in color reproducibility). Here, the luminance in sRGB (50% in color reproducibility) is the one obtained when green has been displayed by shining the green pixel (G) with 255-gradation, shining the red pixel (R) with 38-gradation and shining the blue pixel (B) with 82-gradation in FIG. 5.

Figures 8, 9:
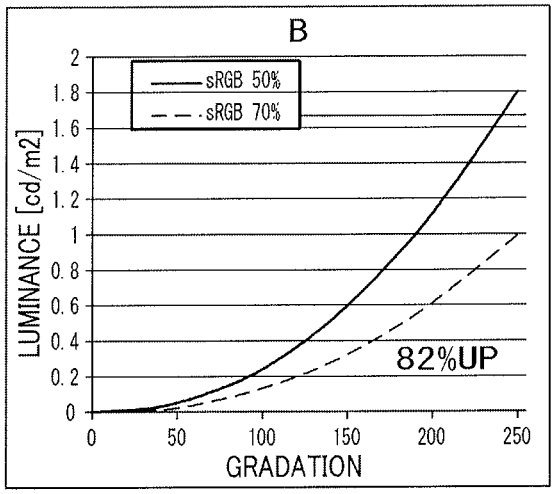
FIG. 8 is a graph illustrating an example that luminances of blue light attained by related art and the present invention are compared with each other.
FIG. 9 is a table indicating examples of luminance increase rates of respective colors attained by the present invention relative to those by related art.

FIG. 8 illustrates an example of comparison between gradation-based luminance between sRGB (70% in color reproducibility) and sRGB (50% in color reproducibility) for blue display. In FIG. 8, the horizontal axis indicates the gradation and the vertical axis indicates the luminance. In FIG. 8, the dotted line indicates the luminance in sRGB (70% in color reproducibility) and the solid line indicates the luminance in sRGB (50% in color reproducibility). Comparing the maximum luminances attained with 255-gradation, the luminance in sRGB (50% in color reproducibility) is increased by 82% as compared with that in sRGB (70% in color reproducibility). Here, the luminance in sRGB (50% in color reproducibility) is the one obtained when blue has been displayed by shining the blue pixel (B) with 255-gradation and shining the green pixel (G) with 82-gradation in FIG. 5.

FIG. 9 is a table wrapping up results of increasing the respective luminances in FIGS. 6, 7 and 8. As indicated in FIG. 9, even in a case where sRGB (50% in color reproducibility) is adopted, luminance increase rates are greatly different from one another depending on colors as indicated in FIG. 9. This is because the color-matching function of human eyes is the most sensitive to the wavelength of green light, and therefore it means that the luminance has been greatly increased by mixing green by shining the green pixel (G) with 82-gradation as in the case of blue display. On the other hand, in green display, regardless of shining the red pixel (R) with 38-gradation and shining the blue pixel (B) with 82-gradation in addition to shining of the green pixel (G), the luminance increase rate is only 4%. As described above, although the luminance increase rate is low in green display, in order to maintain the predetermined color reproducibility, that is, sRGB (50% in color reproducibility), it is desirable to mix predetermined amounts of red and blue into green also in green display.

It is allowed to incorporate the measure of converting the image signal to suppress the color purity, thereby increasing the luminance as mentioned above into the IC driver illustrated in FIG. 1. As a result, it becomes possible to increase the luminance to ensure the desirable image quality without increasing the luminance of the backlight even in the display device which is used under the environment which is high in illuminance of outdoor light.

What is claimed is:

1. A driving method of liquid crystal display device, comprising:

a liquid crystal display panel in which a TFT substrate on which pixels having pixel electrodes and TFTs are arranged in a matrix and a counter substrate are arranged in opposition to each other, a liquid crystal is nipped and held between the TFT substrate and the counter substrate and on which an IC driver is loaded, wherein the pixels include a red pixel (R), a green pixel (G) and a blue pixel (B), the driving method comprises a first mode and a second mode, under the first mode, when red, green and blue displays are to be performed, the red, green and blue displays are performed singly by the red pixel (R), the green pixel (G) and the blue pixel (B) respectively, under the second mode, when the red display is to be performed, the red display is performed by shining the pixels other than the red pixel (R) simultaneously with shining of the red pixel, when the green display is to be performed, the green display is performed by shining the pixels other than the green pixel (G) simultaneously with shining of the green pixel, and when the blue display is to be performed, the blue display is performed by shining the pixels other than the blue pixel (B) simultaneously with shining of the blue pixel.

2. The driving method of liquid crystal display device according to claim 1, wherein when the red display is performed, the green pixel (G) is shined simultaneously with shining of the red pixel (R), when the green display is performed, the red pixel (R) and the blue pixel (B) are shined simultaneously with shining of the green pixel, and when the blue display is performed, the green pixel (G) is shined simultaneously with shining of the blue pixel (B).

3. The driving method of liquid crystal display device according to claim 2, wherein a sensor for sensing an illuminance of outdoor light is loaded on the liquid crystal display device, and a driving method under the first mode and a driving method under the second mode are switched on the basis of the illuminance measured by the sensor.

4. The driving method of liquid crystal display device according to claim 1, wherein the second mode is higher in outdoor light illuminance than the first mode.

5. A driving method of liquid crystal display device, comprising:

a liquid crystal display panel in which a TFT substrate on which pixels having pixel electrodes and TFTs are arranged in a matrix and a counter substrate are arranged in opposition to each other, a liquid crystal is nipped and held between the TFT substrate and the counter substrate and on which an IC driver is loaded, wherein the pixels include a red pixel (R), a green pixel (G) and a blue pixel (B), the driving method comprises a first mode and a second mode, under the first mode, when red, green and blue displays are to be performed, image signal data input into the liquid crystal display panel is used, under the second mode, an image signal input into the liquid crystal display panel is converted to form new luminance data and chromaticity data, under the second mode, when the red display is to be performed, the red display is performed by shining the pixels other than the red pixel (R) simultaneously with shining of the red pixel, when the green display is to be performed, the green display is performed by shining the pixels other than the green pixel (G) simultaneously with shining of the green pixel, and when the blue display is to be performed, the blue display is performed by shining the pixels other than the blue pixel (G) simultaneously with shining of the blue pixel.

6. The driving method of liquid crystal display device according to claim 5, wherein a measure for converting the image signal input into the liquid crystal display panel to form the new luminance data and the chromaticity data is included in the IC driver.

7. The driving method of liquid crystal display device according to claim 6, wherein when the red display is performed, the green pixel (G) is shined simultaneously with shining of the red pixel, when the green display is performed, the red pixel (R) and the blue pixel (B) are shined simultaneously with shining of the green pixel, and when blue is to be displayed, the green pixel (G) is shined simultaneously with shining of the blue pixel.

8. The driving method of liquid crystal display device according to claim 7, wherein a sensor for sensing an illuminance of outdoor light is loaded on the liquid crystal display device, and a driving method under the first mode and a driving method under the second mode are switched on the basis of the illuminance measured by the sensor.

9. The driving method of liquid crystal display device according to claim 5, wherein the second mode is higher in outdoor light illuminance than the first mode.

* * * * *

UNITED STATES PATENT AND TRADEMARK OFFICE

CERTIFICATE OF CORRECTION

PATENT NO. : 8,988,473 B2
APPLICATION NO. : 14/011866
DATED : March 24, 2015
INVENTOR(S) : Kengo Okazaki et al.

It is certified that error appears in the above-identified patent and that said Letters Patent is hereby corrected as shown below:

In the Specification

Column 6, line 28, change "y characteristic" to --γ characteristic--; and

In the Claims

Claim 5, column 10, line 4, change "(G)" to --(B)--.

Signed and Sealed this
Eleventh Day of August, 2015

Michelle K. Lee

Michelle K. Lee
*Director of the United States Patent and Trademark Office*